US005546901A

United States Patent [19]

Acker et al.

[11] Patent Number: 5,546,901

[45] Date of Patent: Aug. 20, 1996

[54] ENGINE HOUSING FOR AN ENGINE-DEVICE ASSEMBLY

[75] Inventors: Richard M. Acker, Delafield; Brian T. Brunelli, Greendale; Douglas H. Kautzer, Sussex, all of Wis.

[73] Assignee: Briggs & Stratton Corporation, Wauwatosa, Wis.

[21] Appl. No.: 497,298

[22] Filed: Jun. 30, 1995

[51] Int. Cl.[6] ..... F02F 7/00

[52] U.S. Cl. ..... 123/195 C; 123/2; 123/195 A

[58] Field of Search ..... 123/195 C, 195 A, 123/195 HC, 2, 196 W

[56] References Cited

U.S. PATENT DOCUMENTS

| | | | |
|---|---|---|---|
| 1,701,340 | 12/1929 | Schmidt | 123/195 R |
| 3,046,899 | 7/1962 | Biefang | 417/363 |
| 4,203,710 | 5/1980 | Farr | 123/195 A |
| 4,622,923 | 11/1986 | Nishimura et al. | 123/2 |
| 4,676,065 | 6/1987 | Eberhardt | 417/364 |
| 4,677,940 | 7/1987 | Bracht et al. | 123/2 |
| 4,698,975 | 10/1987 | Tsukamoto et al. | 123/2 |
| 4,779,905 | 10/1988 | Ito et al. | 123/2 |
| 4,859,886 | 8/1989 | Tanaka et al. | 123/2 |
| 5,031,591 | 7/1991 | Shinoda et al. | 123/196 W |
| 5,376,877 | 12/1994 | Kern et al. | 322/32 |
| 5,458,100 | 10/1995 | Neuenfeld | 123/195 A |

*Primary Examiner*—Noah P. Kamen
*Attorney, Agent, or Firm*—Michael, Best & Friedrich

[57] ABSTRACT

An engine housing for a vertical crankshaft engine may be directly mounted to a standard generator, pump, or other device without modifying the device housing. The engine housing has a plurality of raised mounting bosses that are used to attach the device housing to the engine housing. If the engine housing has an oil slinger well, the raised mounting bosses extend from the engine housing surface a sufficient distance to provide clearance for the oil slinger well. The engine housing also has a pilot that either receives an adapter ring or a portion of a device pilot to maintain the concentricity between the engine crankshaft and the device shaft, as well as the proper alignment between the engine housing and the device housing.

16 Claims, 3 Drawing Sheets

FIG. 1
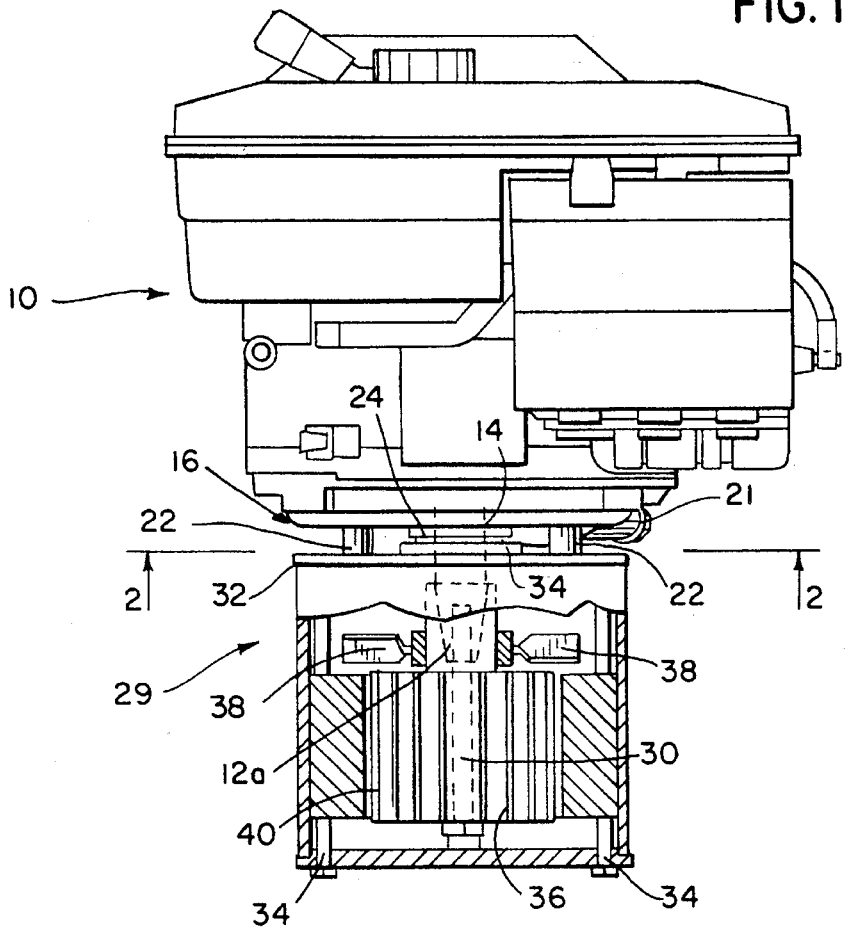
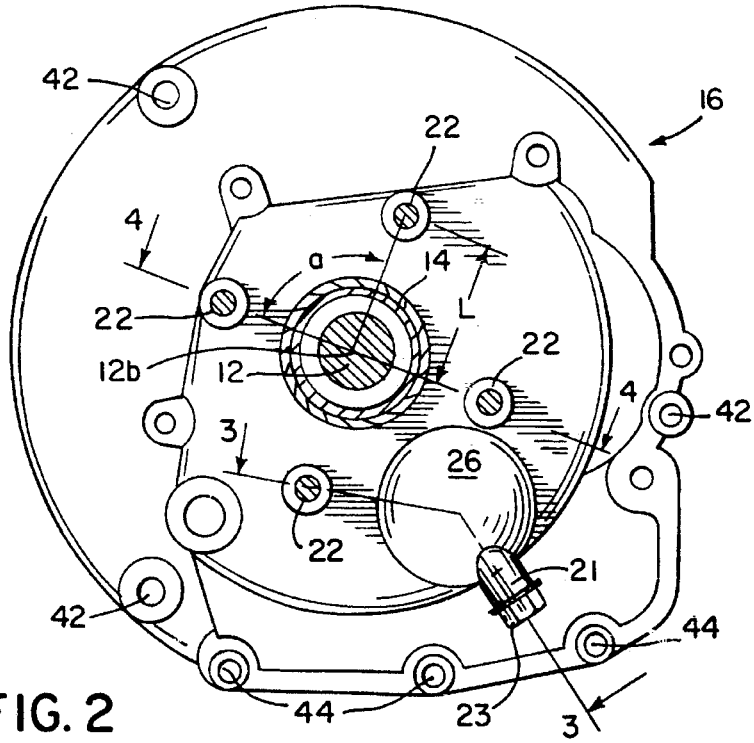
FIG. 2

FIG. 3
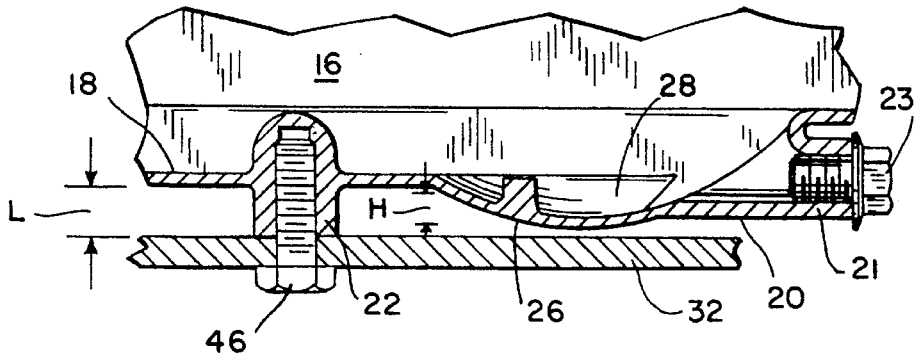
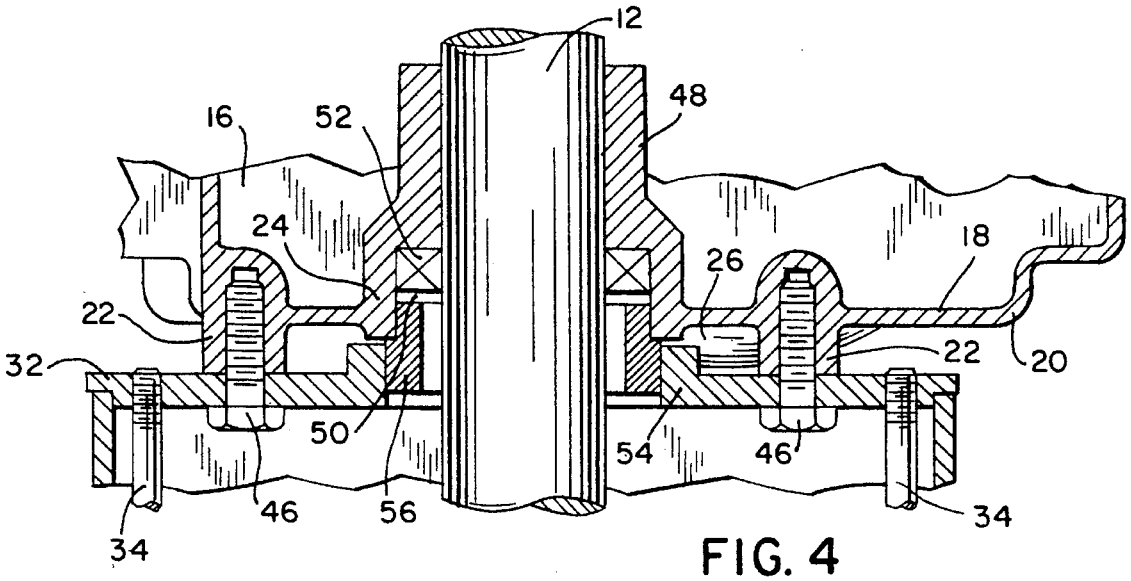
FIG. 4
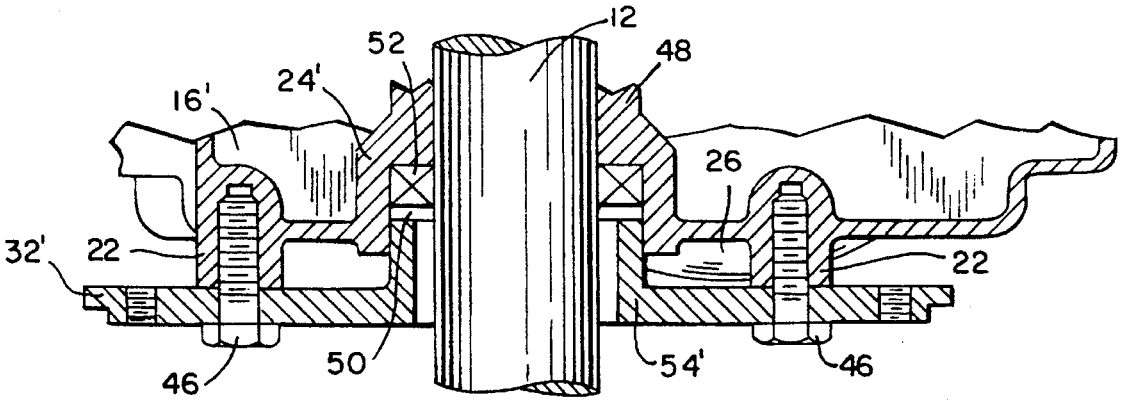
FIG. 5

ENGINE HOUSING FOR AN ENGINE-DEVICE ASSEMBLY

BACKGROUND OF THE INVENTION

This invention relates to assemblies in which a device is driven by and mounted to an engine. More particularly, this invention relates to an engine housing that is used to directly mount an electrical generator end (herein known as a "generator end") or a pump to a vertical shaft, internal combustion engine.

Generators are commonly used to provide either emergency power or power at remote locations. These generators are typically driven by an internal combustion engine, with the engine-generator end assembly being mounted in a generator frame structure.

Engine-pump assemblies are also known for use in pressure washers. Pressure washers provide a fluid, such as water, at high pressure to wash motor vehicles, buildings, and other items.

Several different ways have been used to connect the generator end, pump or other device to the engine, so that the device is driven by an extended engine crankshaft. For example, the engine and the generator may be integrally formed within a single housing, as in U.S. Pat. No. 4,859,886 issued Aug. 22, 1989 to Tanaka et. al. The disadvantage of this assembly, however, is that the generator must be specially manufactured. In U.S. Pat. No. 4,677,940 issued Jul. 7, 1987 to Bracht et. al., a vertical shaft engine directly drives a generator end, but again the generator must be specially designed for use with the particular engine.

Therefore, it is desirable to provide an engine-device assembly wherein a standard device, such as a generator or a pump, may be mounted to a vertical shaft engine.

SUMMARY OF THE INVENTION

A unique engine housing for a vertical shaft engine is provided that enables a standard generator end, pump or other device to be directly mounted to the engine housing, without modification.

In a preferred embodiment, the engine housing includes an upper engine housing section that encloses a portion of the engine components, and a unique lower engine housing section having a first side that at least partially encloses the engine. The first side may have a recess that receives an engine component, such as an oil slinger. The lower engine housing section also includes a second side that may have a projection opposite to the recess. The projection extends from the second side by a height H. In each of the embodiments, a plurality of raised mounting bosses extend from the second side of the lower engine housing section, the mounting bosses extending a length L from the second side. To provide sufficient clearance for the projection when a projection is used, length L of the raised mounting bosses is greater than or equal to height H of the projection. In the alternative, the lower engine housing section may not have a recess in its first side nor an opposed projection extending from its second side. However, the raised mounting bosses are still used for proper alignment between lower engine housing section and the device housing.

The engine housing also includes an aperture through the first and second sides of the lower housing section, with the extended crankshaft extending through the aperture. A raised pilot extends from the second side, and is disposed and spaced from the aperture. An oil seal is preferably disposed between the pilot and the crankshaft in an oil recess groove.

In one embodiment of the invention, an adapter member is at least partially disposed between the engine pilot and the crankshaft, and at least partially surrounds the crankshaft. The adapter member helps maintain the concentricity between the engine crankshaft and the drive shaft of the driven device. The adapter member is not necessary if the housing of the driven device includes a device pilot that is at least partially received within a specially-designed engine pilot on the lower engine housing section.

The raised mounting bosses on the lower engine housing section are arranged according to a SAE standard, in which the mounting bosses are disposed 90° from each other, and about 1.8125 inches from the centerline of the aperture. This arrangement of the mounting bosses ensures that a standard generator, pump or other device may be mounted to the vertical shaft engine without modification. The lower engine housing section also includes a second plurality of mounting bosses that are used to mount the engine housing to a frame.

It is a feature and advantage of the present invention to enable a housing of a driven device to be directly mounted to a vertical shaft engine without modification or additional components.

It is yet another feature and advantage of the present invention to provide an engine housing to which a driven device from a wide variety of manufacturers may be mounted without modification.

It is yet another feature and advantage of the present invention to directly mount a standard generator, pump or other device to an engine housing while maintaining the concentricity between the engine crankshaft and the driven shaft.

These and other features and advantages of the present invention will be apparent to those skilled in the art from the following detailed description of the preferred embodiments, and the drawings, in which:

BRIEF DESCRIPTION OF THE DRAWINGS

FIG. 1 is a side view of a vertical shaft engine-generator assembly according to the present invention, shown in partial section.

FIG. 2 is a bottom view of one embodiment of a lower engine housing section according to the present invention, taken along line 2—2 of FIG. 1.

FIG. 3 is an exploded view of an engine mounting boss according to the present invention, taken along line 3—3 of FIG. 2.

FIG. 4 is a side cross sectional view of a generator housing mounted to an engine housing section according to the present invention, taken along line 4—4 of FIG. 2.

FIG. 5 is an alternate embodiment of the engine housing section of the present invention for use with a second type of generator housing.

DETAIL DESCRIPTION OF THE PREFERRED EMBODIMENTS

Figure 6:
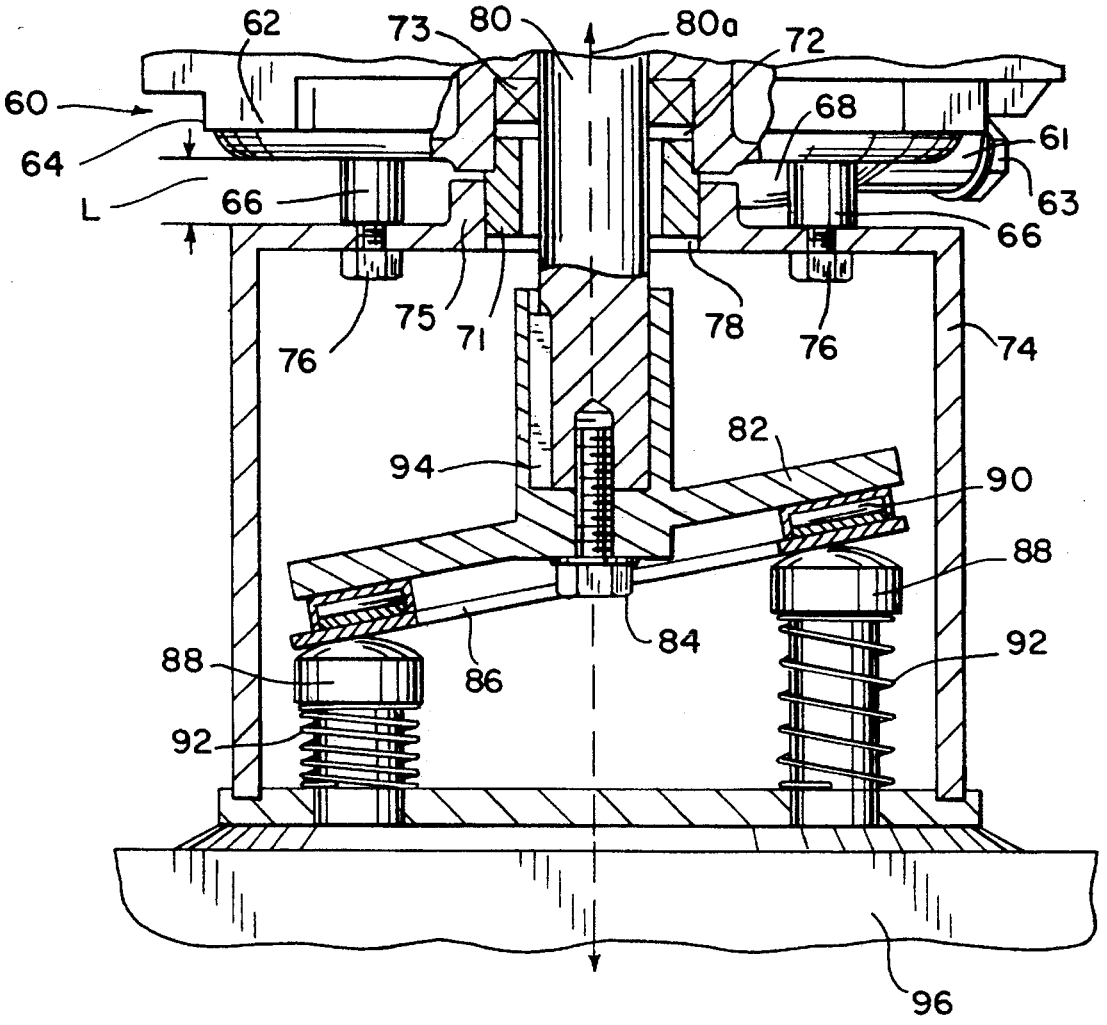
FIG. 6 is a side view of a vertical shaft engine-pump assembly according to the present invention, shown in partial section.

FIG. 1 is a side view, shown in partial section, of a vertical shaft engine-generator assembly according to the present invention. The engine housing may comprise a unitary housing, or it may have an upper section and one or more lower housing sections. In FIG. 1, engine 10 has a vertically-disposed crankshaft 12 (shown in phantom) that extends through an aperture 14 in a lower engine housing section 16. Crankshaft 12 has a centerline 12*b* that is coincident with the centerline of aperture 14. Housing section 16 includes the oil reservoir or sump for the engine. Housing section 16 has a first side 18 (FIGS. 3 through 5) and an opposite second side 20 (FIGS. 3 through 5). Lower engine housing section 16 also includes a threaded oil drain boss 21 having an oil drain plug 23. Extending from second side 20 are a plurality of raised mounting bosses 22 and an engine pilot ring 24. The mounting bosses and the pilot ring are best shown in FIGS. 4 and 5. Also extending from second side 20 is a projection 26, which is opposite to a well or recess 28 in first side 18 of engine housing section 20. Well 28 and projection 26 are best shown in FIGS. 3 through 5. Some lower engine housing sections will not have a well 28 or a projection 26.

The engine housing according to the present invention may be mounted to a standard generator housing, without modifying the generator housing. In typical prior art engine-generator assemblies, a customized generator housing is required. A key feature of the present invention is that the generator shaft is directly mounted to the engine crankshaft, and the generator housing is directly mounted to the engine housing, without modification to the generator assembly.

Referring again to FIG. 1, engine crankshaft 12 is directly connected to generator shaft 30 at a crankshaft tapered end 12*a*. There are a number of ways in which generator shaft 30 may be connected to crankshaft end 12*a*, including the use of tapers, keyways, and threaded connections.

Generator 29 includes an upper generator housing 32 that is directly mounted to engine housing section 16. Extending from generator housing section 32 is a generator pilot ring 34 which, together with engine pilot 24, helps ensure concentricity between engine crankshaft 12 and generator stator 40. There are a number of other ways to ensure concentricity between crankshaft 12 and stator 40, such as including cast or machined features on lower engine housing section 16.

Generator 29 also includes a plurality of throughbolts 34 that keep the generator housing together.

Generator 29 also includes a rotor 36 affixed to shaft 30. A plurality of fan blades 38 extend from shaft 30. Disposed about rotor 36 and shaft 30 is a stator 40, as is well known in the art.

FIG. 2 is a bottom view of engine housing 16 that more clearly depicts several features of the present invention. In FIG. 2, mounting bosses 16 are arranged about centerline 12*b* of crankshaft 12 in a pattern that corresponds to a SAE Recommended Practice, entitled "Mounting Flanges and Power Take-Off Shafts for Small Engines-SAE J609a" last revised July, 1965, Chapter 26, pages 26 through 27, FIG. 1, and incorporated by reference herein. Mounting bosses 22 have this arrangement, so that a generator, pump, or other device may be mounted to the vertical-shaft engine without modification of the device or device housing. According to the SAE J609a Standard, the mounting bosses are disposed 90° from each other, so that angle a in FIG. 2 equals 90°. Also according to this SAE standard, each of mounting bosses 22 is disposed at a radius r of 1 13/16 inches from centerline 12*b*, or 1.8125 inches. Of course, other arrangements of the mounting bosses could be used, as long as the arrangement complies with a commonly-accepted practice, so that the device housing need not be modified for direct connection to the engine housing.

As also shown in FIG. 2, engine housing section 16 includes a plurality of additional mounting bosses 42 that are used to mount the engine to a frame structure for stability. As also shown in FIG. 2, bolts 44 mount lower engine section 16 to an upper engine section.

FIGS. 3 through 5 depict another important feature of the present invention. By way of background, the vertical crankshaft engine depicted in FIGS. 3 through 5 has an oil slinger disposed in well 28 (FIG. 3) that slings the oil in the sump (engine housing section 16) to lubricate the moving components of the engine. Well 28 has a corresponding projection 26 that projects a height H from second side 20 of engine housing section 16. To enable engine housing section 16 to be directly mounted to generator housing section 32 while providing the necessary concentricity between crankshaft 12 and drive shaft 30, the present invention includes a plurality of raised mounting bosses 22 that extend from second side 20 by a length L, with length L being greater than or equal to height H. Length L is preferably between 0.0625 to 0.500 inches. In this way, projection 26 does not contact generator mounting section 32, so that the engine and the generator may be properly aligned with each other. A mounting bolt 46 is disposed in each of mounting bosses 22.

FIGS. 4 and 5 depict other features of the present invention that are used to maintain the concentricity between engine crankshaft 12 and generator stator 40. FIGS. 4 and 5 are alternate embodiments of the lower engine housing section that are used with different types of standard generators. The embodiment depicted in FIG. 4 corresponds to the embodiment depicted in FIGS. 1 and 2.

In FIG. 4, crankshaft 12 is kept in alignment by a crankshaft bearing 48 disposed within engine housing 16 and formed integral with housing 16. Engine pilot 24 extends from bearing 48 and is spaced from crankshaft 12. Engine pilot 24 defines an oil recess groove 50 in which an oil seal 52 is disposed. Oil seal 52 may be of the single-lipped or the double-lipped type.

The type of generator housing depicted in FIG. 4 includes a raised generator pilot 54 that engages a raised portion of engine pilot 24. A substantially cylindrical adapter ring 56 is disposed radially inward from engine pilot 24 in oil recess groove 50, as well as radially inward from generator pilot 54. Adapter ring 56 may be spaced from crankshaft 12, as best shown in FIG. 2.

The embodiment depicted in FIG. 5 has a slightly different configuration due to the differences in the generator housing. In FIG. 5, a generator housing 32' has an extended generator pilot 54' that is substantially longer in the axial direction than generator pilot 54 in FIG. 4. To accommodate extended generator pilot 54', engine housing section 16' has engine pilot 24' that is spaced further from crankshaft 12 when compared to engine pilot 24 in FIG. 4, so that generator pilot 54' is at least partially disposed within radially inward engine pilot 24'. Adapter ring 56 in FIG. 4 is unnecessary in the embodiment of FIG. 5 since extended generator pilot 54' has the same function as the adapter ring, namely to maintain the concentricity between crankshaft 12 and generator shaft 30 and the proper alignment of engine housing section 16' to generator housing section 32'.

FIG. 6 is a side view, shown in partial section, of an engine-pump assembly incorporating the present invention. Components in FIG. 6, as in all the figures, that are substantially the same as components in other drawings have been given the same designations. In FIG. 6, lower engine housing section 60 includes a first side 62 and an opposite second side 64. Lower engine housing 60 includes a threaded oil drain boss 61 that receives an oil drain plug 63. Extending from second side 64 are a plurality of raised mounting bosses 66, each having a length L. Also extending from second side 64 is a projection 68 that has a height H. Projection 68 is opposed by a well (not shown) that holds an oil slinger, as discussed above in connection with FIGS. 1 through 4. Some engine housing sections do not have a projection 68. In the event that projection 68 is provided, it is desirable that length L be greater than or equal to height H to provide for proper alignment between the pump and the engine housing.

Also extending from lower engine housing section 64 is an engine pilot 70 that at least partially surrounds an adapter ring 71 disposed in oil recess groove 72. An oil seal 73 is also disposed in groove 72.

Pump housing 74 includes a pump pilot 75 extending therefrom. A portion of adapter ring 71 is disposed radially inward from pump pilot 75. Pump housing 74 is mounted to the low engine housing section via bolts 76, which in turn are received within mounting bosses 66.

In the alternative, a piloting arrangement similar to the one depicted in FIG. 5 could also be used for the engine-pump assembly.

In FIG. 6, pump housing 74 includes an aperture 78 through which extends an engine crankshaft 80. A swash plate 82 receives extended crankshaft 80, and is bolted thereto via a bolt 84.

Affixed to swash plate 82 is a wear plate 86 that engages reciprocable pistons 88. A needle bearing 90 is disposed between wear plate 86 and swash plate 82. Return springs 92 return pistons 88 to their uppermost positions. Swash plate 82 is kept in registration with crankshaft 80 by a keyway 94.

The engine-pump assembly operates in the following manner. As crankshaft 80 rotates, swash plate 82 and wear plate 86 rotate therewith. The wear plate engages pistons 88, thereby causing them to reciprocate in a manner that is well known in the art. As the pistons reciprocate, they compress water or another fluid in pump head 96 to pump the fluid.

As in the engine-generator assembly discussed above in connection with FIGS. 1 through 4, engine housing section 60 preferably includes 4 spaced mounting bosses 66 that are arranged in accordance with the SAE J609a Standard, such that the mounting bosses are disposed 90° from each other and each of the mounting bosses is disposed 1.8125 inches from centerline 80*a* of crankshaft 80.

Although FIG. 6 depicts the invention incorporated into an engine-swash plate pump assembly, it will be apparent to those skilled in the art that the present invention may be incorporated into assemblies that include other types of pumps, or even other types of devices altogether, as long as the pump or other device does not need to be modified for connection to the vertical shaft engine housing.

While several embodiments of the present invention have been shown and described, alternate embodiments will be apparent to those skilled in the art and are within the intended scope of the present invention. Therefore, the invention is to be limited only by the following claims.

We claim:

1. An engine housing for an internal combustion engine, said engine having a vertically-disposed crankshaft during engine operation, said engine housing comprising:

an engine housing section, including
a first side that at least partially encloses said engine;
a second side opposite to said first side;

an aperture through said first side and said second side, said crankshaft extending through said aperture; and four raised mounting bosses extending from said second side and disposed about said aperture, each of said mounting bosses being positioned 90 degrees from an adjacent mounting boss, said bosses being used to attach a device to said engine housing.

2. The engine housing of claim 1, wherein said aperture has a centerline, and wherein each of said raised mounting bosses is disposed about 1.8125 inches in a radial direction from said centerline.

3. The engine housing of claim 1, further comprising:

a second plurality of mounting bosses that is used to mount said housing section to a frame.

4. The engine housing of claim 1, wherein said first side has a recess that receives an engine component, wherein said second side has a projection that extends from said second side by a height H, and wherein each of said raised mounting bosses extends a length L from said second side, said length L being greater than or equal to said height H.

5. An engine housing for an internal combustion engine, said engine having a vertically-disposed crankshaft during engine operation, said engine housing comprising:

an engine housing section, including
a first side that at least partially encloses said engine;
a second side opposite to said first side;

an aperture through said first side and said second side, said crankshaft extending through said aperture;

a plurality of raised mounting bosses extending from said second side that are used to attach a device to said housing; and a pilot extending from said second side that is disposed about said aperture and that is spaced from said aperture.

6. The engine housing of claim 5, further comprising:

an adapter member, at least partially disposed between said pilot and said crankshaft, that at least partially surrounds said crankshaft.

7. The engine housing of claim 5, further comprising:

an oil seal disposed between said pilot and said crankshaft.

8. An engine housing for an engine having a vertically-disposed extended crankshaft that drives a device, said device having a device housing section that is attachable to said engine housing, said engine housing comprising:

an engine housing section, including
a first side that at least partially encloses said engine;
a second side opposite to said first side;

an aperture through said first side and said second side, said crankshaft extending through said aperture;

a plurality of raised mounting bosses extending from said second side that are used to attach said device housing section to said engine housing; and an engine pilot extending from said second side that is disposed about said aperture and that is spaced from said aperture, said engine pilot engaging a pilot on said device.

9. The engine housing of claim 8, wherein said engine pilot at least partially surrounds said device pilot when said device housing section is attached to said engine housing section.

10. The engine housing of claim 8, further comprising:

an oil seal disposed between said pilot and said crankshaft.

11. The engine housing of claim 8, further comprising:

an adapter member, at least partially disposed between said engine pilot and said crankshaft, that at least partially surrounds said crankshaft.

12. An engine housing for an engine having a vertically-disposed extended crankshaft that drives a device, said device having a device housing section that is attachable to said engine housing, said engine housing comprising:

an engine housing section, including a first side that at least partially encloses said engine;

a second side opposite to said first side;

an aperture through said first side and said second side, said crankshaft extending through said aperture; and four mounting bosses extending from said second side and disposed about said aperture, each of said mounting bosses being positioned 90 degrees from an adjacent mounting boss, said bosses being used to attach said device housing section to said engine housing.

13. The engine housing of claim 12, wherein said aperture has a centerline, and wherein each of said mounting bosses is disposed about 1.8125 inches in a radial direction from said centerline.

14. The engine housing of claim 12, wherein said first side has a recess that receives an engine component, wherein said second side has a projection that extends from said second side by a height H, and wherein each of said raised mounting bosses extends a length L from said second side, said length L being greater than or equal to said height H.

15. The engine housing of claim 12, wherein said device is a generator.

16. The engine housing of claim 12, wherein said device is a pump.

* * * * *